United States Patent [19]

Hauk et al.

[11] Patent Number: 4,708,736

[45] Date of Patent: Nov. 24, 1987

[54] METHOD OF PRODUCING MOLTEN PIG IRON OR STEEL PRE-PRODUCTS FROM PARTICULATE FERROUS MATERIAL

[75] Inventors: Rolf Hauk, Düsseldorf, Fed. Rep. of Germany; Werner Kepplinger, Linz, Austria

[73] Assignees: Voest-Alpine Akt., Austria; Korf Engineering GmbH, Fed. Rep. of Germany

[21] Appl. No.: 838,669

[22] Filed: Mar. 12, 1986

[30] Foreign Application Priority Data

Mar. 21, 1985 [AT] Austria ..... 846/85

[51] Int. Cl.[4] ..... C21B 11/00

[52] U.S. Cl. ..... 75/26; 75/38; 75/43; 48/92

[58] Field of Search ..... 75/38, 40, 43, 26; 48/92

[56] References Cited

U.S. PATENT DOCUMENTS 3,948,640 4/1976 Elvander et al. ..... 75/10.17

4,564,389 1/1986 Yamaoka et al. ..... 75/43

*Primary Examiner*—Melvyn J. Andrews

*Attorney, Agent, or Firm*—Ostrolenk, Faber, Gerb & Soffen

[57] ABSTRACT

In a method of producing molten pig iron or steel pre-products from particulate ferrous material, as well as of producing reduction gas in a melt-down gasifier by adding coal and by blowing in oxygen-containing gas by means of nozzle pipes penetrating the wall of the melt-down gasifier, a fixed bed formed of coke particles, through which the oxygen-containing gas flows and a superposed fluidized bed of coke particles are formed, and the ferrous material is charged onto the fluidized bed. Below the fixed bed through which oxygen-containing gas flows, a fixed bed of coke particles not passed through by gas is provided, and the fluidized bed above the fixed bed passed through by oxygen-containing gas is passed through by a gas free from oxygen or having a low oxygen content.

2 Claims, 1 Drawing Figure

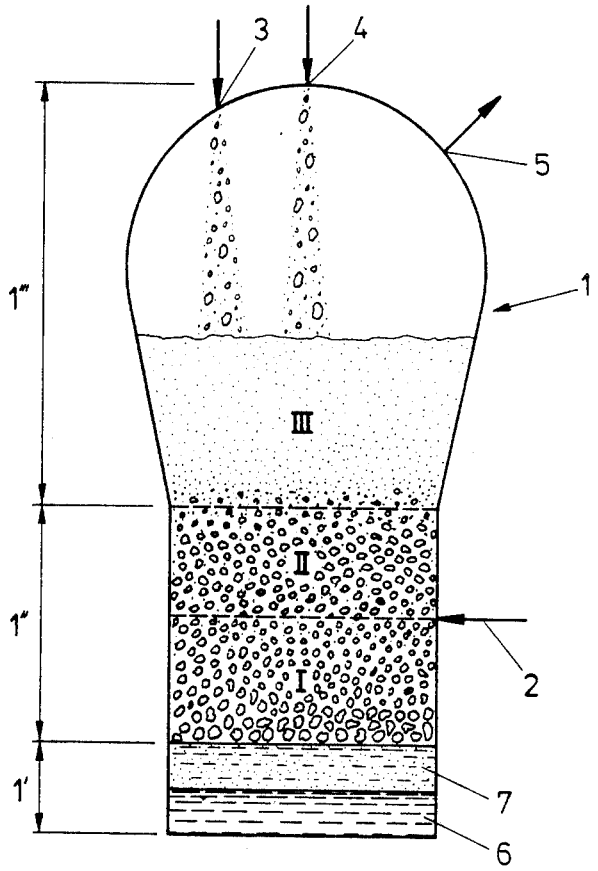
3
4
5
1
1'''
III
II
1''
I
2
1'
7
6

METHOD OF PRODUCING MOLTEN PIG IRON OR STEEL PRE-PRODUCTS FROM PARTICULATE FERROUS MATERIAL

BACKGROUND OF THE INVENTION

1. Field of the Invention

The invention relates to a method of producing molten pig iron or steel pre-products from particulate ferrous material, in particular from pre-reduced iron sponge, as well as of producing reduction gas in a melt-down gasifier by adding coal and by blowing in oxygen-containing gas by means of nozzle pipes penetrating the wall of the melt-down gasifier, wherein a fixed bed formed of coke particles through which the oxygen-containing gas flows and a superposed fluidized bed of coke particles are formed and the ferrous material is charged onto the fluidized bed.

2. Description of the Related Art

A method of the defined kind is disclosed in EP-Al No. 0 114 040, wherein the oxygen-containing gas is injected at two different levels, i.e. into the fixed bed and into the superposed fluidized bed of coke particles.

The described combination of a fixed bed zone with a superposed fluidized bed zone allows for an increase in the melting output and an increase in the temperature of the molten metal, whereby certain metallurgical reactions are facilitated. Larger particles of the material introduced into the melt-down gasifier which are not smelted in the fluidized bed, are kept back by the fixed bed and do not immediately reach the melt bath that has a temperature of from 1400–1500° C., collecting in the lower part of the melt-down gasifier. In the melt bath, metal and slag separate due to their different densities.

Although the combination of a fixed bed zone with a fluidized bed zone offers advantages in the manner known from EP-Al No. 0 114 040, substantial disadvantages persist. The partial reoxidation of the pre-reduced ferrous particles necessarily occurring in the fluidized bed zone (fluidized layer) to which oxygen-containing gas is admitted, can be reversed only partly in the fixed bed zone lying therebelow to which also oxygen-containing gas is admitted. Also, the dwell time of the particles and the temperature in the fixed bed do not suffice to obtain a substantial carburization. Thus pig iron having a sufficient bath temperature, yet having a low content of chemical heat carriers, such as carbon, silicon and manganese, is obtained.

SUMMARY OF THE INVENTION

The invention aims at avoiding the difficulties described and has as its object a method that prevents reoxidation of the molten products in the melt-down gasifier and reduces the amount of primary energy required.

According to the invention, a method is described that provides below the fixed bed through which oxygen-containing gas flows, a fixed bed of coke particles not passed through by gas. The fluidized bed above the fixed bed passed through by oxygen-containing gas is passed through by a gas free from oxygen or having a low oxygen content.

The larger particles of the coal supplied to the melt-down gasifier from above or of the other carbonaceous fuels deposit from the fluidized bed into the fixed bed.

The two fixed bed zones comprise coke particles having a grain size of from 20 to 60 mm, substantially by particles having a size of between 30 and 40 mm, while the smaller particles are in the fluidized bed zone.

Suitably, the height of the fixed bed flowed through by the oxygen-containing gas is adjusted and maintained via the grain size distribution of the coal introduced into the melt-down gasifier.

The fixed bed may be formed particularly pronounced, if the grain classification of the coarse portion of the coal introduced lies within narrow limits.

The drawing in which a melt-down gasifier is schematically illustrated, explains in more detail how the method according to the invention is carried out.

BRIEF DESCRIPTION OF THE DRAWINGS

The drawing illustrates a melt-down gasifier employing a method according to the present invention.

DETAILED DESCRIPTION OF THE PREFERRED EMBODIMENT

The refractorily lined melt-down gasifier 1 has a lower section 1', a middle section 1'' and an enlarged upper section 1'''. The lower section 1' accomodatesthe molten bath. Into the middle section 1'' feed lines (nozzle pipes) 2 for oxygen-containing gas enter, and into the upper enlarged section 1''' supply means 3 for lumpy coal or coke, and 4 for pre-reduced iron particles, such as iron sponge, enter. Furthermore, at least one discharge means 5 for the reduction gas formed is provided in the upper section. In the middle section 1'' the fixed beds (fixed bed zones) denoted by I and II are formed of coarser coke particles. The melt bath collecting therebelow consists of the molten metal 6 and the slag 7. A tap may be provided for each of the two components. The fixed bed I has no gas supply; thus it is not passed through by gas. Thereabove, the fixed bed II is formed, in which the coke particles contact oxygen-containing gas flowing in from the supply lines 2, thus forming carbon monoxide. Above the fixed bed II, a fluidized bed III is formed, which is not provided with gas feed lines. The fluidized bed is kept in motion exclusively by the carbon monoxide-containing reaction gases forming in fixed bed II. Small coal or coke particles remain in fluidized bed zone III. Larger coal or coke particles, for which the clear tube velocity of the gas flow lies below the loosening point of a corresponding particle bed, are only braked, and thus fall through the fluidized bed III and deposit while forming the fixed bed II or the fixed bed I, respectively.

Due to the fact that in zone III no oxygen or oxygen-containing gas is admitted, this zone has a reducing gas atmosphere, thus the carbon content of the pre-reduced ferrous particles, such as iron sponge, introduced from above is maintained.

In fixed bed II, heat required for the process is produced in a known manner by gasifying coal. The heat is communicated counterflow to the iron sponge to be melted, and the melt formed, which is comprised of slag and metal, is superheated. It must be superheated so much (approximately to 1,600° C.) that the thermal demand for the endothermal reactions occurring in fixed bed zones I and II is met and the melt collected in the lower part of the melt-down gasifier has a temperature that still suffices for further treatment.

In the fixed bed zones I and II in which, with the exception of the immediate region in front of the nozzle pipes 2, oxidizing conditions do not prevail, there occurs a direct reaction between the solid carbon and silicon and manganese. Also an increase in the carbon content of the iron bath is possible, whereby lower carbon contents in the iron sponge used are necessary; i.e., lower demands are made on the operation in the preceeding direct reduction shaft furnace. The adjustment of lower carbon contents in the iron sponge goes hand in hand with a lower gas consumption in the shaft furnace. Smaller amounts of reducing gas furthermore involve smaller amounts of coal for the gas production in the melt-down gasifier and smaller amounts of top gas from the direct reduction shaft furnace, which corresponds to a decreased demand of primary energy.

A further advantage of the method according to the invention consists in that the installation and instrumentation require less expenditures, since, as compared to the prior art, one nozzle level is omitted.

The following is an example for carrying out the method according to the invention:

To obtain 1,000 kg of pig iron, 1,060 kg of iron sponge having a metallization degree of 80%, a carbon content of 1% and a temperature of 800° C. were top-charged from a direct reduction shaft furnace into a melt-down gasifier. Simultaneously, 700 kg of anthrazite/t pig iron were supplied. Also, 500 $m^3$ (under normal conditions) of oxygen/t pig iron was introduced through the supply lines 2. The nozzle level is adjusted to approximately the middle of the fixed bed II, and the gas has a temperature of more than 2,000° C. At the border between fixed bed II and fluidized bed III a gas temperature of 1,800° C. and the ferrous particles have a temperature of from 1,200 to 1,300° C. At the transition from zone II into zone I a temperature of the iron carriers of 1,600° C. adjusted. The slag or metal bath had a temperature of from 1,400 to 1,500° C.; in the enlarged upper section 1''' of the melt-down gasifier, a gas temperature of 1,500° C. was measured at the upper border of fluidized bed III, and a gas temperature of 1,100° C. in the superposed so-called killing zone. The reduction gas was drawn off via discharge means 5 in an amount of 1,330 $m^3$ (under normal conditions)/t pig iron, the pig iron formed had a C-content of 3.5%, an Si-content of 0.3% and an S- content of 0.1%.

What we claim is:

1. In a method of producing molten pig iron or steel pre-products from pre-reduced iron-sponge, as well as of producing reduction gas in a melt-down gasifier having a wall by adding coal and by blowing in oxygen-containing gas by means of nozzle pipes penetrating said wall of said melt-down gasifier, a fixed bed of coke particles flowed through by said oxygen-containing gas and a superposed fluidized bed of coke particles being formed, said ferrous material being charged onto said fluidized bed, the improvement comprising providing a further fixed bed of coke particles below said fixed bed, said further fixed bed being not flowed through by gas, said fluidized bed being located above said fixed bed and being flowed through by one of an oxygen-free and an oxygen-poor gas, said gasifier having sufficient volume above said fixed bed to confine said fluidized bed.

2. A method as set forth in claim 1, further comprising adjusting and maintaining the height of said fixed bed flowed through by said oxygen-containing gas via the grain size distribution of said coal introduced into said melt-down gasifier.

* * * * *